United States Patent [19]

Vieux et al.

[11] Patent Number: 4,862,006

[45] Date of Patent: Aug. 29, 1989

[54] METHOD OF FABRICATION OF AN X-RAY IMAGE INTENSIFIER AND AN X-RAY IMAGE INTENSIFIER THUS OBTAINED

[75] Inventors: Gérard Vieux, Grenoble; Henri Rougeot, Nazaire Les Eymes; Francis Diaz, Moirance, all of France

[73] Assignee: Thomson-CSF, Paris, France

[21] Appl. No.: 61,980

[22] Filed: Jun. 15, 1987

[30] Foreign Application Priority Data

Jun. 16, 1986 [FR] France ..... 8608588

[51] Int. Cl.[4] ..... H01J 31/52

[52] U.S. Cl. ..... 250/483.1; 250/487.1; 250/213 VT

[58] Field of Search ..... 250/483.1, 487.1, 213 VT

[56] References Cited

U.S. PATENT DOCUMENTS

| | | | |
|---|---|---|---|
| 3,592,522 | 7/1971 | Rougeot | 445/9 |
| 3,812,369 | 5/1974 | Rougeot | 250/553 |
| 4,059,766 | 11/1977 | Rougeot | 250/370.08 |
| 4,069,121 | 1/1978 | Baud et al. | 204/129.3 |
| 4,101,770 | 7/1978 | Rougeot et al. | 250/363 |
| 4,119,852 | 10/1978 | Rougeot | 250/370.1 |
| 4,122,345 | 10/1978 | Rougeot | 250/370.1 |
| 4,147,933 | 4/1979 | Rougeot et al. | 250/370.1 |
| 4,229,736 | 10/1980 | Rougeot | 340/782 |
| 4,647,811 | 1/1985 | Galves et al. | 313/372 |

FOREIGN PATENT DOCUMENTS

| | | | |
|---|---|---|---|
| 2168553 | 8/1973 | France . | |
| 2176850 | 11/1973 | France . | |
| 2527836 | 12/1983 | France | 250/483.1 |
| 2149200 | 6/1985 | United Kingdom . | |

*Primary Examiner*—Janice A. Howell
*Assistant Examiner*—Richard Hanig
*Attorney, Agent, or Firm*—Oblon, Spivak, McClelland, Maier & Neustadt

[57] ABSTRACT

Before being introduced within the intensifier, the grid which is nearest the anode is coated with a layer of electrically conductive material having the property of oxidizing alkali metals. This has the effect of elininating any parasitic illumination of the viewing screen caused by alkali metals unintentionally deposited on the grid at the time of formation of the photocathode.

12 Claims, 2 Drawing Sheets

METHOD OF FABRICATION OF AN X-RAY IMAGE INTENSIFIER AND AN X-RAY IMAGE INTENSIFIER THUS OBTAINED

BACKGROUND OF THE INVENTION

1. Field of the Invention

The present invention relates to a method of fabrication of an x-ray image intensifier as well as to the x-ray image intensifiers thus obtained.

2. Description of the Prior Art

X-ray image intensifiers, also designated as X.I.I. tubes, are well-known in the prior art. Their function is to convert an x-ray image to a visible image for such purposes as medical observation, for example.

It is recalled that an X.I.I. tube as shown diagrammatically in longitudinal cross-section in FIG. 1 consists of an input screen, an electron-optical system and a viewing screen which are contained within a vacuum enclosure 1.

The input screen is provided with a scintillator 2 for converting the incident x-ray photons to visible photons and a photocathode 3 for converting the visible photons to electrons. There is usually interposed between the scintillator and the photocathode an electrically conductive sub-layer having the function of re-supplying the photocathode with electric charges during emission of its electrons. This sub-layer is not shown in FIG. 1.

The scintillator can consist, for example, of sodium or thallium doped cesium iodide. The photocathode can be formed of an alkali antimonide corresponding, for example, to the formula $Sb\ Cs_3$, $Sb\ K_3$, $Sb\ K_2\ Cs$ . . . . By way of example, the conductive sub-layer can be formed of indium oxide having the formula $In_2O_3$.

The electron-optical system is usually constituted by three electrodes $G_1$, $G_2$, $G_3$ and by an anode A which carries the viewing screen 4.

The photocathode 3 is usually connected to the ground of the tube. The electrodes $G_1$, $G_2$, $G_3$ and the anode A are brought to electric potentials which rise to a value of 30 KV, for example. An electric field E is accordingly produced within the tube and is directed along the longitudinal axis of the tube towards the photocathode. The electrons emitted from the photocathode pass upstream through said field and strike the viewing screen 4 which is formed of cathodoluminescent material such as zinc sulphide, for example, thus making it possible to obtain a visible image.

The problem which arises and for which the present invention offers a solution is that objectionable parasitic illumination of the viewing screen is observed in X.I.I. tubes, even in the absence of x-radiation. This parasitic illumination is due to the alkali metals which are unintentionally deposited on the electrodes of the X.I.I. tube at the time of fabrication of the photocathode. The intense electric field which prevails within the tube has the effect of stripping electrons from these alkali metals which are highly electropositive and therefore very readily ionizable. These electrons move upstream through the electric field, strike the viewing screen and produce parasitic illumination.

This phenomenon is illustrated in FIG. 2 which is a part-sectional view of the grid $G_3$ and of the anode A of the X.I.I. tube of FIG. 1. The reference numeral 7 designates the alkali metal layer which has been deposited on the grid $G_3$. Under the action of the electric field E which is maintained between the grid $G_3$ and the anode A and which is directed towards the grid $G_3$, said layer liberates electrons which move upstream through the electric field and strike the viewing screen 4.

It must be realized that the fabrication of photocathodes of the alkali antimonide type is performed within the vacuum enclosure of the X.I.I. tube since alkali metals are highly reactive and have to be formed in vacuo in order to be stable. These photocathodes can be fabricated by successive evaporations of their constituent elements. To this end, there is placed within the tube an antimony generator consisting of an ordinary crucible which contains antimony and in which evaporation is produced by heating the crucible by Joule effect, for example. The antimony generator 5 is usually placed in proximity to the photocathode and on the path of the electrons as shown in FIG. 1. It is for this reason that the generator is usually removed from the enclosure once the photocathode has been completely formed. The alkali metals are evaporated from alkali-metal generators 6, these generators being usually located on the electrode $G_3$ which is nearest the anode A as shown in FIG. 1.

The alkali-metal generators are usually left within the vacuum enclosure once the photocathode has been completed. In some known methods of fabrication of X.I.I. tubes, the alkali-metal generators are not carried by the electrode $G_3$ and are removed from the vacuum enclosure when fabrication of the photocathode has been completed.

Evaporation of the alkali metals is the result of a silicothermic reaction or aluminothermic reaction in the presence of chromates of the metals to be evaporated. The silicothermic or aluminothermic reactions are initiated by Joule heating of the alkalimetal generators.

The alkali-metal generators just mentioned are much less directional than the antimony generators. This is due to the fact that, in order to ensure that the silicothermic or aluminothermic reactions take place under good conditions, it is necessary to employ special crucibles in which the chromates are confined. This type of crucible exhibits poor directivity which has the advantage of ensuring wholly uniform deposition of the alkali metals over the entire surface of the photocathode which is located at a distance from these crucibles 6. The disadvantage of this crucible, however, lies in the fact that it causes deposition of alkali metals on all the parts of the X.I.I. tube and in particular on the electrodes $G_1$, $G_2$ and $G_3$, thus giving rise to the problem of parasitic illumination of the viewing screen.

In order to solve this problem, one solution adopted by the present Applicant is to form an oxide coating on the electrode $G_3$ which is usually formed of aluminum.

This solution does in fact eliminate the problem of parasitic illumination of the viewing screen but introduces discharges through the oxide coating or layer.

When the X.I.I. tube receives x-radiation, a part of the electrons emitted from the photocathode falls on the electrode $G_3$. Since the electrode $G_3$ is coated with an oxide layer, these electrons do not flow, thus giving rise to discharges through the oxide layer.

SUMMARY OF THE INVENTION

A solution to the problem discussed in the foregoing is proposed in the present invention and is not attended by the disadvantages of the known solution.

The present invention is directed to a method of fabrication of an x-ray image intensifier including in particular a photocathode formed of alkali antimonide, a plurality of grids and an anode, the method being distinguished by the fact that a layer of electrically conductive material having the property of oxidizing the alkali metals employed as constituents of the photocathode is deposited on at least a portion of the grid located nearest the anode before introducing said grid within the intensifier.

DESCRIPTION OF THE PREFERRED EMBODIMENT

In the different figures, the same references designate the same elements but the dimensions and proportions of the various elements have not been observed for the sake of enhanced clarity.

Figure 1:
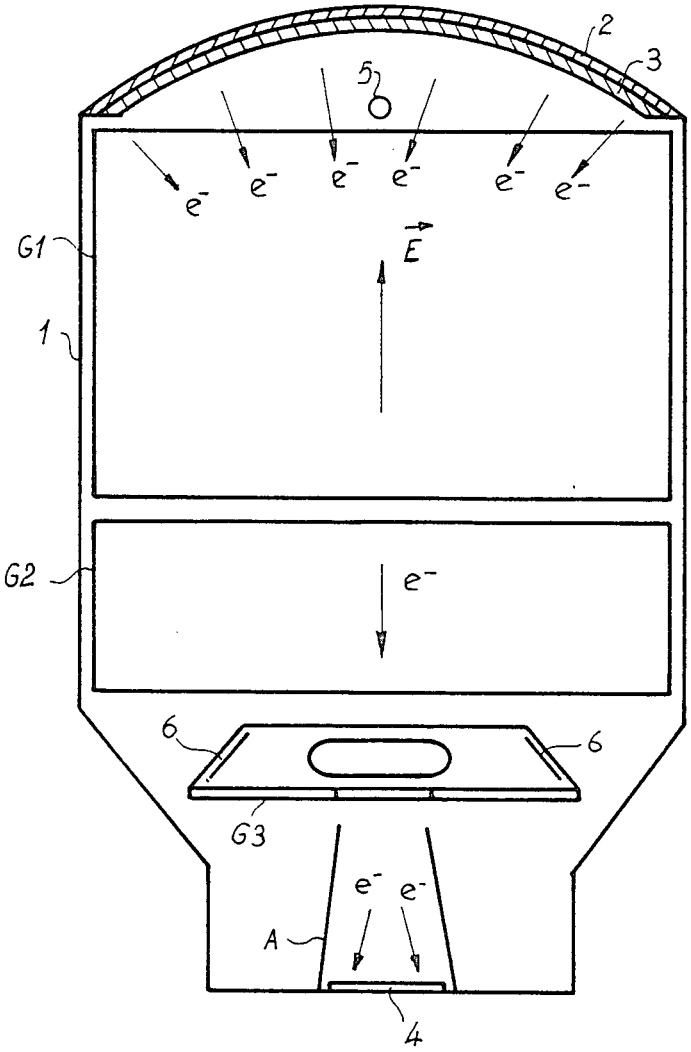
FIG 1 PRIOR ART
FIG. 1 is a longitudinal sectional view of an X.I.I. tube.
Figure 2:
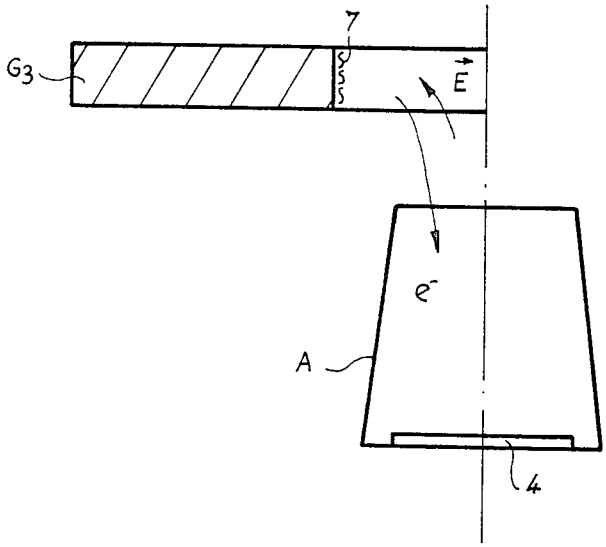
FIGS. 2 and 3 are sectional views of the grid $G_3$ and of the anode A of the X.I.I. tube of FIG. 1 and illustrate the known solution in accordance with the prior art and the solution provided by the invention.

FIGS. 1 and 2 have already been described in the introductory part of the description.

Figure 3:
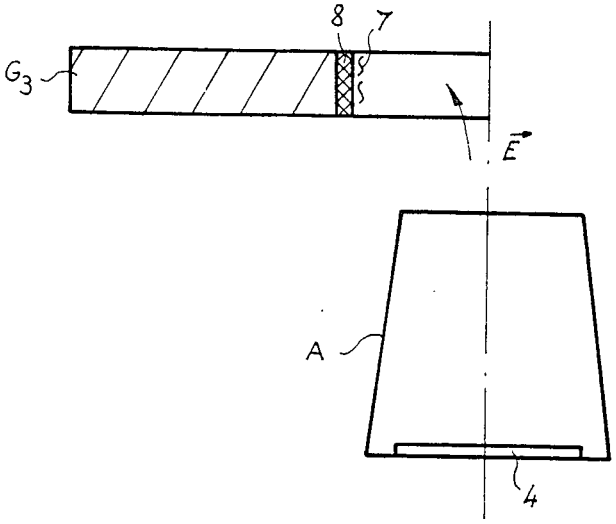

FIG. 3 is a partial sectional view of the grid $G_3$ and of the anode A of the X.I.I. tube of FIG. 1 and illustrates the arrangement provided by the invention for solving the problem of parasitic illumination mentioned earlier.

In accordance with the invention, the grid $G_3$ on which the antimony generators are usually fixed is provided with a layer of electrically conductive material which has the property of oxidizing the alkali metals, said oxidizing layer being deposited on the grid before introducing this latter within the vacuum enclosure of the X.I.I. tube.

The problem of parasitic iliumination is due to the metallic nature of the parasitic alkali metals. The solution proposed by the invention is to cause these alkali metals to react chemically with a material which is capable of oxidizing them and converting them to ionic or covalent compounds. Thus the alkali metals are fixed and no longer liberate electrons which produce parasitic illumination, thus overcoming the problem which it has been endeavored to solve. The deposit employed must in addition be electrically conductive in order to guard against the discharge phenomena which were encountered in the prior art when an oxide layer covered the electrode $G_3$.

In order to form a covering layer on the electrode $G_3$ of the X.I.I. tube before this electrode is introduced within the tube, the present invention proposes the preferential use of one of the following elements: selenium, tellurium, sulfur, arsenic, phosphorus, antimony, and so on.

These elements may be employed either alone or in the form of compounds having for example one of the following formulae: Pb Te, Cd Te, Zn Te, In Te, Pb Se, Cd Se, Zn Se, In Se, Pb S, Cd S, Zn S, $Zn_3 P_2$ . . . .

In FIG. 3, it is shown that the electrode $G_3$ is coated with a layer 8 of tellurium, for example, before being introduced within the X.I.I. tube. It is possible to coat the entire electrode $G_3$ with tellurium or, as is the case in FIG. 3, only those zones of the electrode $G_3$ in which the phenomenon of parasitic illumination is most liable to occur. These zones can be determined by experiment. They can also be determined by computation by making use of computer programs. As a general rule, the zones which are the most liable to give rise to the phenomenon of parasitic illumination are sharply curved zones having a short radius of curvature and a very strong electric field. These zones are located in proximity to the alkali-metal generators and to the viewing screen. It is apparent from FIG. 3 that the periphery of the opening of the grid $G_3$ through which the electrons are permitted to pass has been coated with the layer 8.

The arrival of parasitic alkali metals at the time of fabrication of the photocathode gives rise to the following reaction at the surface of the tellurium layer 8 in the event of evaporation of the cesium:

$$2\ Cs + Te \rightarrow Cs_2\ Te$$

There are therefore found on the layer 8, not alkali metals but compounds which include these alkali metals.

Owing to the presence of these compounds such as the compound having the formula $Cs_2T_e$, and in spite of the electric field which exists between the grid $G_3$ and the cathode, there is no longer observed any electron emission which gives rise to parasitic illumination of the viewing screen.

Moreover, the discharge problem noted earlier is eliminated by the presence of the layer 8 which is sufficiently conductive. This layer 8 additionally contains compounds formed by this latter with alkali metals. However, whether these compounds are conductive or not, this does not alter the fact that the layer 8 is sufficiently conductive to ensure that there is no problem of discharge and breakdown.

By way of example, when cesium is evaporated and when the layer 8 is of lead telluride, the reaction is as follows:

$$2\ Cs + Pb\ Te \rightarrow Cs_2\ Te + \langle Pb \rangle_{Pb\ Te}$$

Lead is therefore generated and remains dissolved in the lead telluride layer 8.

The layer 8 of electrically conductive material having the property of oxidizing the alkali metals is deposited at least on the electrode $G_3$ which usually carries the alkali-metal generators and which is located nearest the anode.

In order to achieve more complete elimination of parasitic illumination of the viewing screen, said layer 8 is also deposited on the grid $G_2$.

As a precautionary measure, the layer 8 can also be deposited on the grid $G_1$ as well as, more generally, on any component of the X.I.I. tube which is to be electrically connected to an electrode of said tube, that is, either to one of the grids or to the anode.

A number of different methods may be adopted for the purpose of depositing the layer 8.

One of these methods consists in depositing the layer 8 by evaporation from a crucible containing the product to be deposited and heated by Joule effect and by causing the vapor evolved from the crucible to condense on the surfaces to be coated with the layer 8.

Another method consists in dipping the parts to be coated with the layer 8 in a reactive chemical bath containing the product to be deposited.

Another method consists of electrolysis. In this case, the part to be coated constitutes an electrode which dips into an electrolytic bath.

Deposition of the layer 8 may also be performed by cathode sputtering or by making use of a plasma.

All the methods mentioned in the foregoing for carrying out deposition of the layer 8 are well-known and a list of these methods cannot be considered in any limiting sense.

As explained earlier, there is no difficulty attached to deposition of the layer 8 on all the grids $G_1$, $G_2$, $G_3$ and on the components which are connected electrically to an electrode of the X.I.I. tube or only on part of these grids and components.

What is claimed is:

1. A method of fabrication of an X-ray image intensifier including in particular a photocathode formed of alkali antimonide, a plurality of grids and an anode, said method comprising the steps of:

fabricating of said photocathode within said intensifier;

introducing said plurality of grids within said intensifier wherein at least one of said plurality of grids is introduced before said step of fabricating of said photocathode; and depositing on at least a portion of a first one of said plurality of grids which is to be located nearest an anode a layer of electrically conductive material having the property of oxidizing alkali metals employed as constituents of the photocathode before introducing said first grid within the intensifier.

2. A method according to claim 1, wherein a layer of electrically conductive material having the property of oxidizing the alkali metals employed as constituents of the photocathode is deposited on at least a portion of a second grid located next to said first grid before introducing said second grid within the intensifier.

3. A method according to claim 1 or claim 2, wherein a layer of electrically conductive material having the property of oxidizing the alkali metals employed as constituents of the photocathode is deposited on at least a portion of each of said grids of the intensifier before introducing said grids into said intensifier.

4. A method according to claim 3, wherein a layer of electrically conductive material having the property of oxidizing the alkali metals employed as constituents of the photocathode is deposited on at least a portion of all the parts of the intensifier which have to be electrically connected to one of the grids or to the anode of the intensifier before introducing them into said intensifier.

5. A method according to claim 1, wherein deposition of said layer is performed in accordance with one of the following techniques: deposition by condensation, deposition by dipping in a chemical bath, deposition by electrolysis, deposition by cathode sputtering, deposition by plasma.

6. An x-ray image intensifier including in particular a photocathode formed of alkali antimonide, a plurality of grids and an anode, wherein at least a portion of the grid which is located nearest the anode carries a layer of electrically conductive material having the property of oxidizing the alkali metals employed as constituents of the photocathode.

7. An intensifier according to claim 6, wherein at least a portion of the grid located next to the grid which is nearest the anode includes a layer of electrically conductive material having the property of oxidizing the alkali metals employed as constituents of the photocathode.

8. An intensifier according to claim 6 or claim 7, wherein the other grids of the intensifier are adapted to includes on at least a portion thereof a layer of electrically conductive material having the property of oxidizing the alkali metals employed as constituents of the photocathode.

9. An intensifier according to claim 8, wherein the intensifier components which are electrically connected to one of the grids or to the anode of the intensifier include at least on a portion thereof a layer of electrically conductive material having the property of oxidizing the alkali metals employed as constituents of the photocathode.

10. An intensifier according to claim 6, wherein said material is one of the following elements: selenium, tellurium, sulfur, arsenic, phosphorus, antimony.

11. An intensifier according to claim 6, wherein said material is a compound which includes one of the following elements : selenium, tellurium, sulfur, arsenic, phosphorus, antimony.

12. An intensifier according to claim 11, wherein the compound is one of the following compounds: Pb Te, Cd Te, Zn Te, In Te, Pb Se, Cd Se, Zn Se, In Se, Pb S, Cd S, Zn S, $Zn_3 P_2$.

* * * * *